US008529037B2

(12) United States Patent
Miyashita et al.

(10) Patent No.: US 8,529,037 B2
(45) Date of Patent: Sep. 10, 2013

(54) INK TANK AND PRODUCTION PROCESS OF INK TANK

(75) Inventors: Takeho Miyashita, Kawasaki (JP); Yasuo Kotaki, Yokohama (JP); Hitoshi Takada, Yokohama (JP); Koichi Kubo, Yokohama (JP); Hiroki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 13/333,761

(22) Filed: Dec. 21, 2011

(65) Prior Publication Data

US 2012/0200647 A1 Aug. 9, 2012

(30) Foreign Application Priority Data

Feb. 3, 2011 (JP) ..... 2011-021793

(51) Int. Cl.
*B41J 2/175* (2006.01)

(52) U.S. Cl.
USPC ..... 347/86

(58) Field of Classification Search
USPC ..... 347/85, 86
See application file for complete search history.

(56) References Cited

U.S. PATENT DOCUMENTS

| | | | | |
|---|---|---|---|---|
| 5,430,471 | A | 7/1995 | Nakajima et al. | 347/87 |
| 5,523,780 | A * | 6/1996 | Hirosawa et al. | 347/86 |
| 5,583,549 | A | 12/1996 | Ujita et al. | 347/86 |
| 5,619,239 | A | 4/1997 | Kotaki et al. | 347/86 |
| 5,988,804 | A | 11/1999 | Kotaki et al. | 347/87 |
| 6,022,102 | A * | 2/2000 | Ikkatai et al. | 347/85 |
| 6,505,923 | B1 | 1/2003 | Yamamoto et al. | 347/85 |
| 6,511,167 | B1 | 1/2003 | Kitabatake et al. | 347/86 |
| 6,540,342 | B2 | 4/2003 | Koshikawa et al. | 347/86 |
| 6,719,415 | B1 | 4/2004 | Hattori et al. | 347/86 |
| 6,832,830 | B2 * | 12/2004 | Seino et al. | 347/86 |
| 6,834,945 | B2 * | 12/2004 | Ishizawa et al. | 347/86 |
| 7,004,574 | B2 * | 2/2006 | Neese et al. | 347/85 |
| 2004/0183870 | A1 | 9/2004 | Steinmetz et al. | 347/85 |
| 2007/0229632 | A1 | 10/2007 | Hatasa et al. | 347/92 |

FOREIGN PATENT DOCUMENTS

| | | |
|---|---|---|
| JP | 2009-298153 | 12/2009 |

* cited by examiner

*Primary Examiner* — Anh T. N. Vo
(74) *Attorney, Agent, or Firm* — Fitzpatrick, Cella, Harper & Scinto

(57) ABSTRACT

An ink tank for being installed in an ink jet recording apparatus to supply ink thereto, including an ink storage portion, one side surface of a casing of the ink tank in which side surface an opening for supplying ink to the apparatus is formed, and a joint member for joining the one side surface to the apparatus by engaging with a connection member of the apparatus. The joint member has a welding portion for being welded to the one side surface along a peripheral portion of the opening, the welding portion corresponding to the peripheral portion; and a hollow portion forming a positioning hole for inserting therein and engaging therewith the connection member for determining a relative position of the apparatus and the one side surface. The hollow portion is provided on the outside of the welding portion and abuts to the one side surface without being welded.

10 Claims, 6 Drawing Sheets

INK TANK AND PRODUCTION PROCESS OF INK TANK

BACKGROUND OF THE INVENTION

1. Field of the Invention

The present invention relates to an ink tank for storing an ink used in an ink jet recording apparatus and a production process for the ink tank.

2. Description of the Related Art

An ink tank used in an ink jet recording apparatus is constructed detachably from the recording apparatus to facilitate replacement when ink has been consumed.

Such an ink tank has a casing 501 storing an ink and a joint member 502 for joining the tank to a recording apparatus body like an ink tank 500 described in Japanese Patent Application Laid-Open No. 2009-298153 and illustrated in, for example, FIG. 7. The ink tank 500 is fixed by welding an outer peripheral edge of the joint member 502 to the casing 501 of the ink tank.

As described above, the joint member of the conventional ink tank forms a "weld ridgeline" along the outer peripheral edge by being welded at its outer peripheral edge, so that the "weld ridgeline" tends to become long as the size of the ink tank becomes large.

However, when an engaged portion with a connection member of the recording apparatus is arranged in the inside of the "weld ridgeline" with the outer peripheral edge of the joint member regarded as the "weld ridgeline" as described above, the reliability of seal property at a welding portion is lowered as the length of the outer peripheral edge forming the "weld ridgeline" becomes long when the ink tank is enlarged. The lowering of the reliability of seal property at the welding portion may cause such a problem that it cannot withstand impact upon falling to cause ink leakage.

SUMMARY OF THE INVENTION

It is an object of the present invention to maintain reliability of seal property of an ink tank without lengthening the length of a weld ridgeline even when the ink tank is enlarged.

The above object is achieved by the present invention described below. More specifically, the present invention provides an ink tank for being installed in an ink jet recording apparatus to supply an ink to the ink jet recording apparatus, the ink tank comprising an ink storage portion storing the ink; one side surface of a casing of the ink tank in which side surface an opening for supplying the ink to the ink jet recording apparatus is formed; and a joint member for joining the one side surface to the ink jet recording apparatus be engaging with a connection member of the ink jet recording apparatus, wherein the joint member has a welding portion for being welded to the one side surface along a peripheral portion of the opening, the welding portion corresponding to the peripheral portion; and a hollow portion forming a positioning hole for inserting therein and engaging therewith the connection member for positioning of determining a relative position of the ink jet recording apparatus and the one side surface which are to be joined to each other, and wherein the hollow portion is provided on the outside of the welding portion and abuts to the one side surface without being welded.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Construction of Ink Tank

Figure 1A:
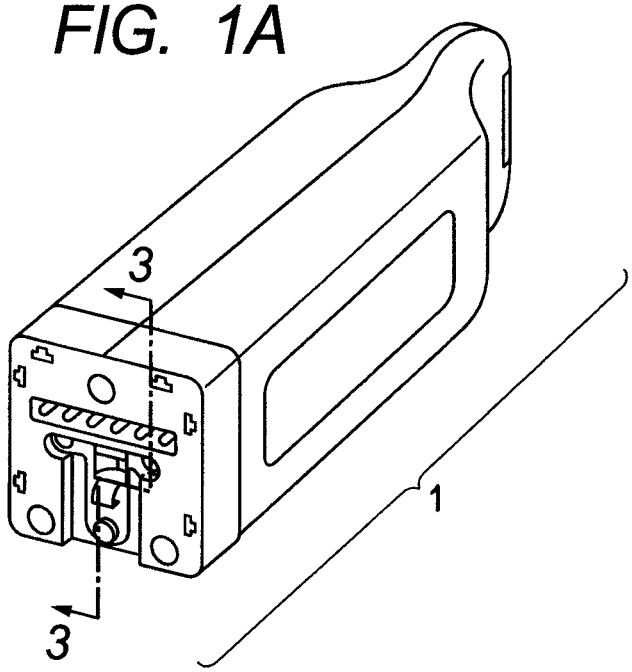
FIG. 1A is a perspective view of an ink tank according to an embodiment of the present invention.

The construction of the ink tank according to this embodiment is described with reference to FIGS. 1A and 1B. FIG. 1A is a perspective view of the ink tank according to this embodiment, and FIG. 1B is an exploded perspective view of the ink tank.

Figure 1B:
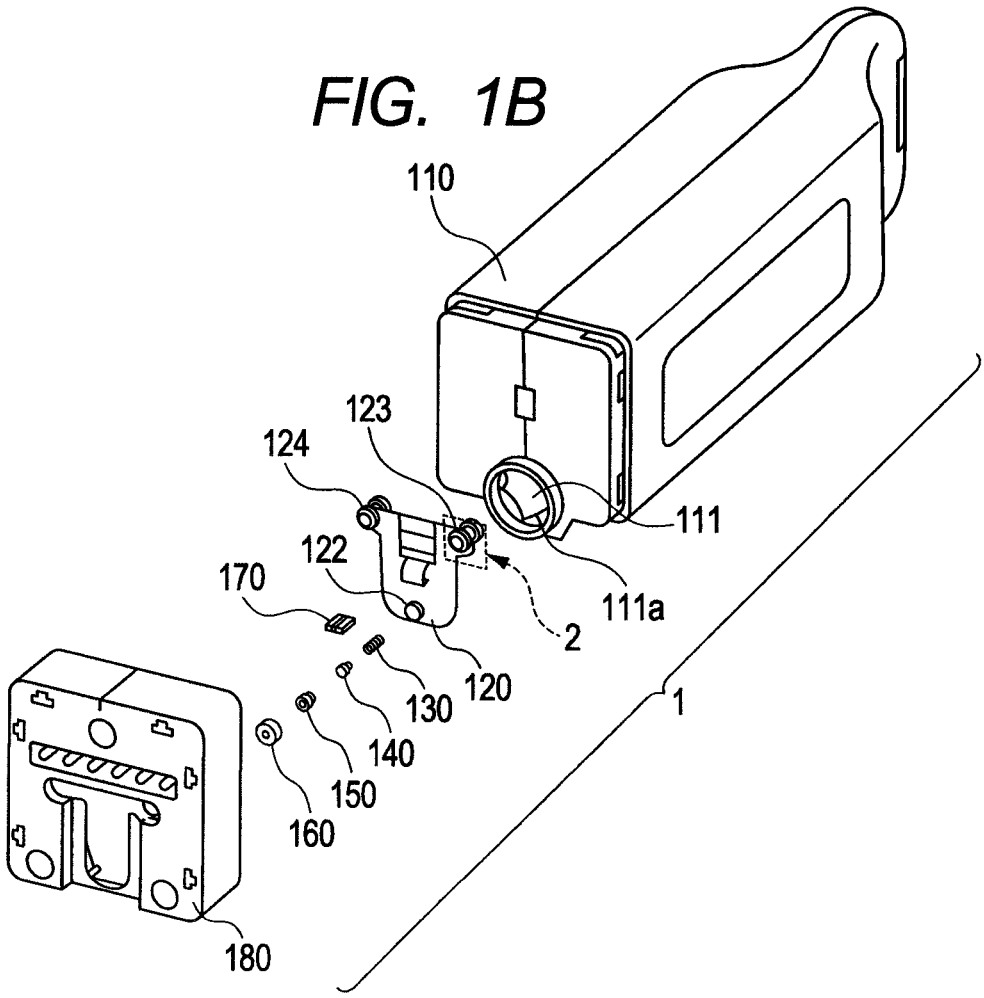
FIG. 1B is an exploded perspective view of the ink tank.

As illustrated in FIG. 1B, the ink tank is mainly constructed by a casing 110 storing an ink, a joint member 120 joining to a recording apparatus body and a cover 180 for protecting the joint member 120. The ink tank is detachably installed in the recording apparatus by the joint member 120.

Incidentally, regarding the recording apparatus body, only a connection member connected to the ink tank is illustrated, and the construction of the body is not illustrated.

Figure 3:
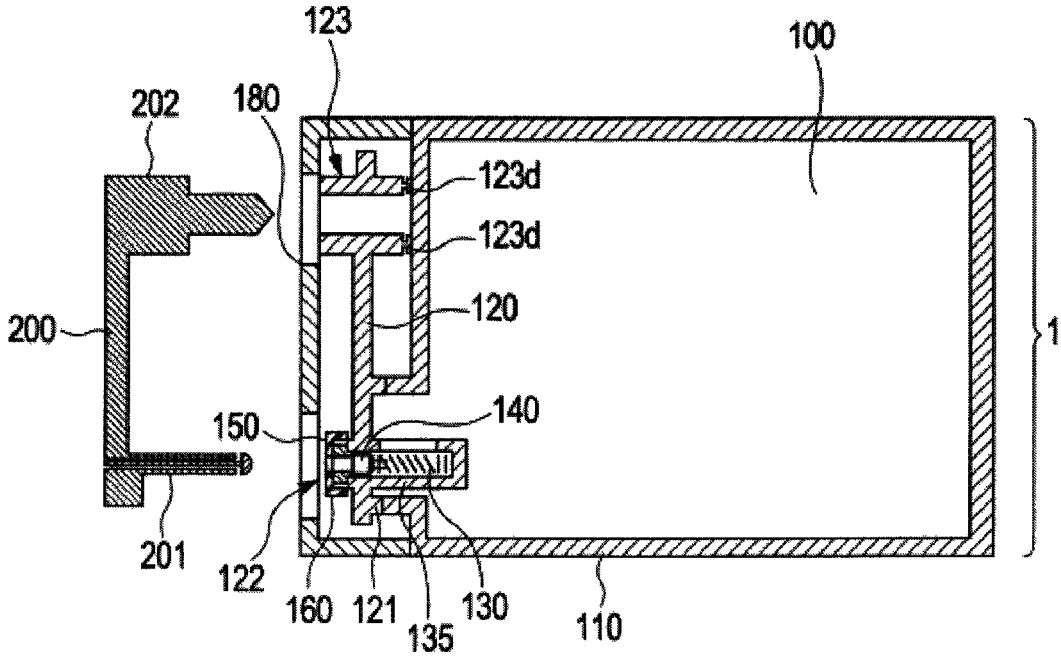
FIG. 3 is a typical sectional view taken along line 3-3 of the ink tank in FIG. 1A.

As illustrated in FIG. 3, a connection unit 200 of the recording apparatus is provided with a connection member 202 (connection member for positioning) for determining a relative position with respect to the ink tank upon installation of the ink tank and an ink supply needle 201 to be inserted into an opening 111 for supplying an ink in the ink tank.

The ink supplied to the recording apparatus by the ink supply needle 201 from the ink tank is ejected from an ink ejection head (not illustrated) of the recording apparatus toward a recording medium to form a recorded image on the recording medium.

Main constructive members of the ink tank will hereinafter be described in detail.

Casing 110:

The casing 110 is a container capable of directly storing a liquid such as an ink and produced by blow molding. As a resin forming the casing 110, polyethylene is used in this embodiment. However, any resin such as polypropylene may also be used so far as it is not dissolved out in an ink.

As illustrated in FIG. 1B, the casing 110 forms an ink storage portion 100 for storing an ink and has an opening 111 for supplying the ink stored in the ink storage portion 100 on one side surface on a side for being connected to the recording apparatus. The casing 110 further has a rib 111*a* projecting from a side surface toward the side of the recording apparatus for welding to the joint member 120 at a peripheral edge of the opening 111.

Joint Member 120:

The joint member 120 is a member produced by injection molding and is formed of polyethylene as in the molding of the casing 110 in this embodiment. Incidentally, regarding the resin used in this production, polypropylene or any other resin may also be used as in the molding of the casing 110. However, the same resin as in the casing 110 is favorably used.

The same resin as in the casing 110 is used to weld the casing 110 to the joint member 120 by a production process which will be described subsequently, thereby inhibiting an interface between different resins from causing a rip to cause cracking.

As illustrated in FIG. 1B, an information memory medium 170 for storing information on the ink stored in the ink storage portion, such as physical properties of the ink and the amount of remaining ink, to enables information transmission to the outside is installed in the joint member 120.

A first feature of the technical points in this embodiment is to weld the joint member 120 to the casing 110 at a peripheral edge of the opening 111 formed in one side surface of the casing 110 for supplying an ink. FIG. 3 typically illustrates the ink tank in cross section taken along line 3-3 in FIG. 1A and the connection unit 200 of the recording apparatus engaged with this ink tank. The joint member 120 has a substantially circular welding portion 121 corresponding to the rib 111*a* provided at a peripheral portion of the opening 111 and is welded to one side surface of the casing 110 at the welding portion 121 to form a substantially circular "weld ridgeline".

The joint member 120 welded to the casing 110 forms an ink supply portion 122 that is an ink supply portion for supplying an ink stored in the ink storage portion 100 on the inside of the "weld ridgeline" formed in the substantially circular form. Here, "inside" means an interior of a circle of the weld ridgeline formed in the substantially circular form, and "outside" means an exterior of the circle.

With the first feature of the technical points in this embodiment, the joint member 120 is provided with a positioning hole 123 for inserting the connection member 202 for positioning of determining a relative position of the recording apparatus and the ink tank on the outside of the "weld ridgeline" formed by the substantially circular welding portion 121.

Incidentally, one of the two positioning holes (123, 124) illustrated in FIG. 1B is illustrated in FIG. 3. However, the same construction as described above is also provided on the side of the positioning hole 124.

As illustrated in FIG. 3, the positioning hole 123 is arranged on the outside of the "weld ridgeline" formed by the weld portion 121 of the joint member 120.

A second feature of the technical points in this embodiment is that the one forming the positioning hole 123 in the joint member 120 abuts to one side surface of the casing 110 without being welded. Specifically, an end portion 123*d* of a hollow portion forming the positioning hole 123 is melted and deformed, thereby forming an abutting surface with respect to the one side surface of the casing 110. However, it abuts to the one side surface in a non-welded state.

The end portion 123*d* of the hollow portion forming the positioning hole 123 is not fixed to the casing 110 as described above, thereby inhibiting the ink tank from being cracked by mechanical stress applied to the ink tank due to mutual rubbing between an inner side surface of the positioning hole 123 and an outer side surface of the connection member 202 when the connection member 202 is inserted into the positioning hole 123 upon installation of the ink tank in the recording apparatus.

As described above, in this embodiment, the joint member 120 is welded to the casing 110 of the ink tank along the peripheral edge of the opening 111 for supplying the ink to form the "weld ridgeline" along the opening 111, whereby the positioning hole 123 is arranged on the outside of the "weld ridgeline". In addition, the end portion 123*d* of the hollow portion forming the positioning hole 123 abuts to the casing 110 without being welded. By such construction, the peripheral length of the opening 111 becomes the whole length of the "weld ridgeline", whereby the length of the "weld ridge" can be shortened, and the breakage of a connection portion caused by rubbing with the connection member 202 for positioning to be inserted into the positioning hole 123 can be inhibited.

More specifically, by the construction like this embodiment, the length of the "weld ridgeline" can be minimized even in an enlarged large-volume ink tank, the breakage that forms a cause of ink leakage can be inhibited, and the seal property of the ink tank can be improved.

The ink supply portion 122 provided on the inside of the "weld ridgeline" is provided with a cylindrical frame 135 formed in the joint member 120. The frame 135 is arranged in the interior of the ink storage portion 100 so as to extend in the inward of the opening 111.

In the frame 135, a first opening opened on the side of the recording apparatus for communicating with the joint member 120 is formed, and a second opening for communicating the interior of the frame 135 with the interior of the ink storage portion 100 is formed in a cylinder side surface of the frame 135. A spring 130, a valve 140 and a seal member 150 that form a valve mechanism capable of opening and closing the opening 111 are incorporated into the interior of this frame 135.

As illustrated in FIG. 3, the valve 140 is biased by the spring 130 for closing a hole of the seal member 150 within the frame 135 when the ink tank is not connected to the recording apparatus body, so that the valve 140 is pressed against the seal member 150.

A cap 160 is put on the seal member 150 so as to prevent coming off of the seal member 150 by the force of the spring 130 as described above, whereby the seal member 150 is fixed. An opening through which the ink supply needle 201 is inserted is formed in the center of the cap 160.

The seal member 150 is fixed to the joint member 120 in this manner, and the valve 140 is surely pressed against the seal member 150, whereby ink leakage from the casing 110 and denaturalization of the ink caused by evaporation are suppressed.

Figure 2:
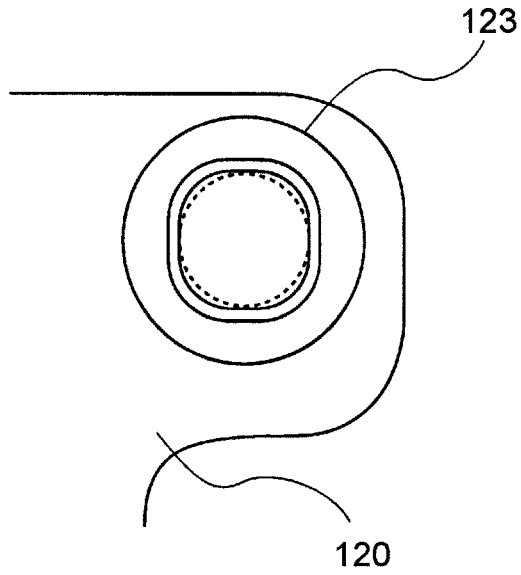
FIG. 2 is an enlarged view of a portion 2 illustrated in FIG. 1B in a joint member.

FIG. 2 is an enlarged view of the portion 2 that is the positioning hole 123 illustrated in FIG. 1B. As illustrated in FIG. 2, the connection member (portion indicated by the dotted line) for positioning on the side of the recording apparatus to be engaged with the positioning hole 123 is columnar in this embodiment as illustrated in FIG. 2. On the other hand, the opening of the positioning hole 123 is set to be a substantially circular form slightly larger than the connection member 202 for positioning for the purpose of reducing rubbing resistance with the connection member 202 for positioning on the side of the recording apparatus.

Cover 180:

As illustrated in FIG. 1B, a cover 180 is installed on the side where the joint member 120 of the casing 110 is welded. The cover 180 favorably does not abut on the outer peripheral portion of the joint member 120 in such a manner that no falling impact is directly applied to the ink supply portion 122 and positioning hole 123 of the joint member 120 even when the side of the cover 180 is impacted on a floor upon falling of the ink tank. Ink leakage and misalignment of the positioning hole 123 are thereby inhibited.

Installation of Ink Tank in Recording Apparatus

Figure 4:
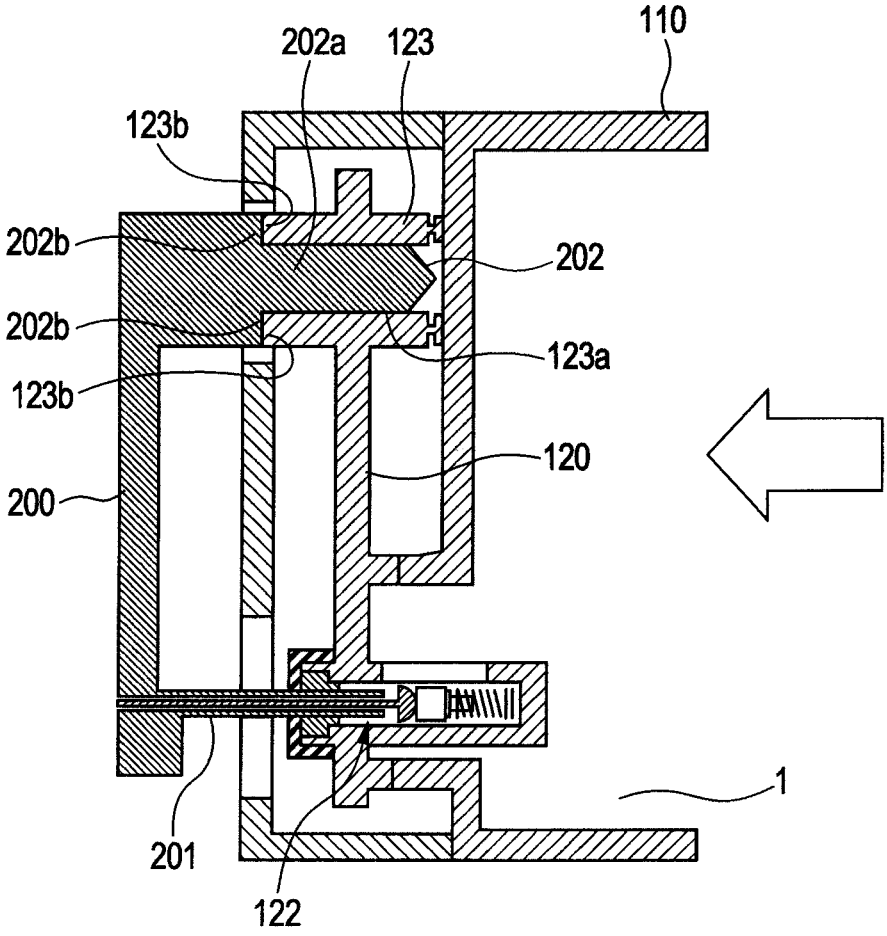
FIG. 4 typically illustrates an engaged state between the ink tank according to the embodiment and a recording apparatus.

A manner that the ink tank 1 is installed in the recording apparatus body is described with reference to FIG. 4. FIG. 4 typically illustrates an enlarged state between the ink supply portion 122 and positioning hole 123 of the joint member 120 in the ink tank and the connection unit 200 of the recording apparatus body that is engaged therewith.

As illustrated in FIG. 4, the connection unit 200 on the side of the recording apparatus is provided with a connection member 202 for positioning to be inserted into the positioning hole 123 of the joint member 120 and an ink supply needle 201 to be inserted into the ink supply portion 122 for supplying an ink from the ink tank to the recording apparatus. In addition, the connection unit 200 is also provided with a connection member 202 (not illustrated) for positioning to be engaged with the positioning hole 124 (see FIG. 1B). Two connection members 202 for positioning that are located side by side along a horizontal direction are inserted into their corresponding positioning holes 123 and 124, whereby a relative position of the ink tank to the recording apparatus is determined, and the ink supply needle 201 is also surely inserted into the ink supply portion 122. Incidentally, the positioning hole 124 has the same structure as the positioning hole 123, so that it will hereinafter be described as the positioning hole 123.

The positioning hole 123 has a portion forming a hollow portion as an insertion space 123*a* into which the connection member 202 for positioning is inserted, and a bumping-receiving portion 123*b* with which the connection member 202 for positioning inserted into the hollow portion bumps to be positioned. On the other hand, the connection member 202 for positioning has an insertion portion 202*a* to be inserted into the hole of the insertion space 123*a* and a bumping portion 202*b* formed with a diameter larger than the insertion portion 202*a* and bumped against the bumping-receiving portion 123*b* to be positioned. The positioning hole 124 also has the same structure as the positioning hole 123.

When the ink tank is installed in the recording apparatus in a direction indicated by the arrow in FIG. 4, the insertion portion 202*a* of the connection member 202 for positioning on the side of the recording apparatus is engaged with the insertion space 123*a* in the positioning hole 123 of the joint member 120, thereby determining the relative positions of the ink tank and the recording apparatus.

The positioning hole 123 abuts to the one side surface of the casing 110, thereby being supported at a predetermined position, so that the connection member 202 for positioning is inserted into the positioning hole 123 to engage them with each other, whereby the ink tank is positioned to the recording apparatus with sufficiently good accuracy.

Welding Process of Joint Member 120

Some processes for welding the joint member 120 to the casing 110 are exemplified.

Welding Process 1 of Joint Member:

An example of a process for welding the joint member 120 to the casing 110 is described with reference to FIGS. 5A to 5C.

Figure 5A:
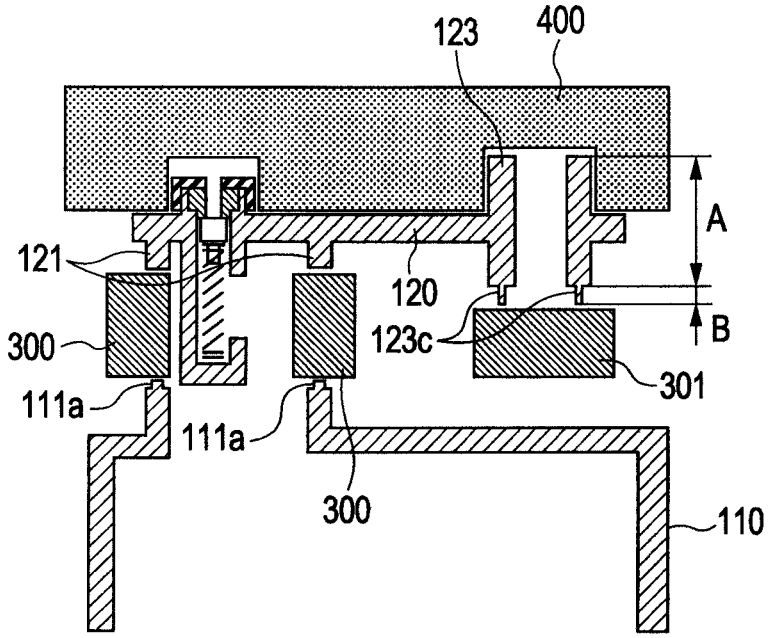
FIGS. 5A, 5B and 5C typically illustrate a process of welding the joint member to a casing of the ink tank in the embodiment.
Figure 5B:
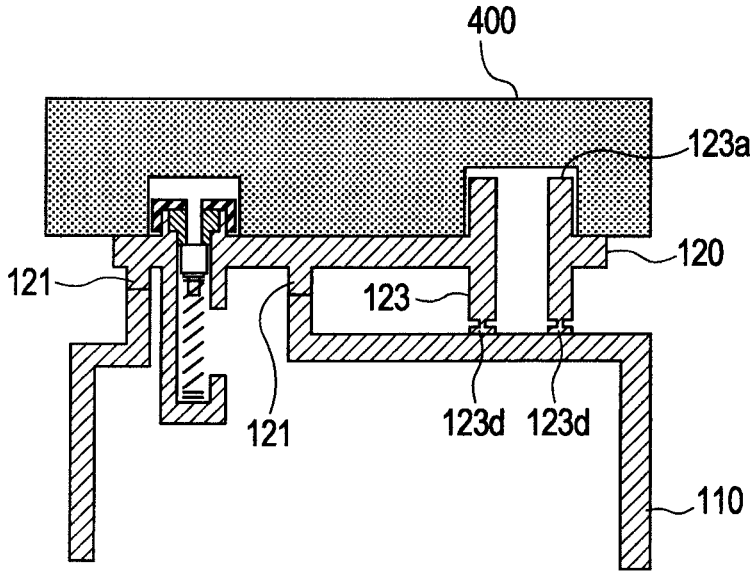
Figure 5C:
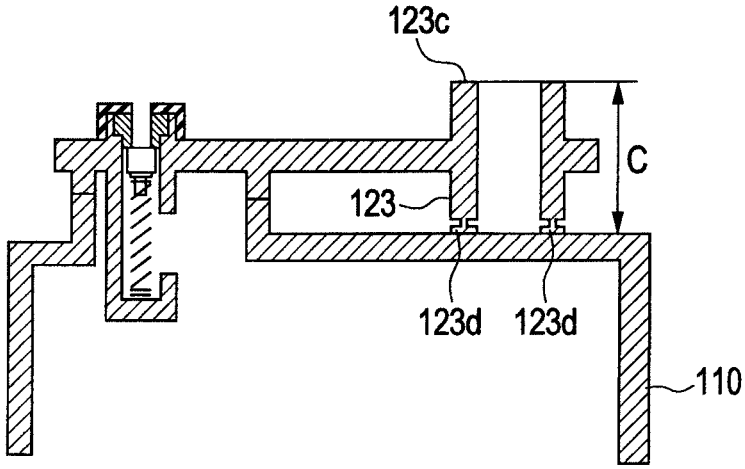

FIGS. 5A to 5C typically illustrate a process of welding the joint member 120 to the casing 110 of the ink tank, in which FIG. 5A illustrates a state where the joint member 120 and the casing 110 are heated, FIG. 5B illustrates a state where the joint member 120 is pressed against the casing 110, and FIG. 5C illustrates a state after welding. Incidentally, only the positioning hole 123 of the 2 positioning holes illustrated in FIG. 1B is illustrated. However, the positioning hole 124 also takes the same state as in the following description.

As illustrated in FIG. 5A, the joint member 120 has a projection portion 123*c* having a wall thinner than that of another portion of the positioning hole 123 at an end portion of the insertion space 123*a* of the positioning hole 123.

The casing 110 is fixed with its side on which the rib 111*a* is provided upward, and the joint member 120 is held over it. In this arrangement, the joint member 120 is held by a holding part 400 as illustrated in FIG. 5A, the welding portion 121 of the joint member 120 and the rib 111*a* of the casing 110 are heated by a heater block 300, and at the same time the projection portion 123*c* of the positioning hole 123 is heated by another heater block 301.

In this manner, heaters for melting are separately provided on a side where the welding portion 121 and the rib 111*a* are melted and on a side where the projection portion 123*c* of the positioning hole 123 is melted, whereby the heating temperatures on both sides can be controlled separately. By such construction, the heating temperature of the projection portion 123*c* can be made higher than the heating temperature of the welding portion 121, and so the projection portion 123*c* can be sufficiently melt-deformed. The projection portion 123*c* is sufficiently melted in this manner, whereby the form of the projection portion 123*c* is easily deformed when the welding portion 121 is welded and joined to the rib 111*a* with the descending of the holding part 400 in a vertical direction as illustrated in FIG. 5B, so that the cumulative height C of the melt-deformed projection portion 123*c* and the insertion space 123*a* as illustrated in FIG. 5C can be precisely controlled.

In this embodiment, the welding portion 121 and the projection portion 123*c* of the joint member 120 and the rib 111*a* of the casing 110 are not brought into contact with the heater blocks 300 and 301 for avoiding adhesion of the resin to the heater blacks 300 and 301 and are heated with radiant heat. However, the heater blocks 300 and 301 are coated in order for the resin not to adhere thereto, and the welding portion 121 and the projection portion 123*c* of the joint member 120 and the rib 111*a* of the casing 110 may be brought into contact with the heater blocks 300 and 301 to heat them.

The heating temperature may be set to a temperature not lower than the melting point of the resin, and the heating time may be set to a time required to sufficiently melt the resin according to the heating temperature. When the heating temperature is made sufficiently higher than the melting point of the resin, the heating time required for the melting can be shortened, so that the process time can be shortened.

In this embodiment, the heating temperature of the welding portion 121 and the rib 111*a* is set to 450° C., the heating temperature of the projection portion 123*c* is set to 480° C., the heating time of the rib 111*a* by the heater blocks 300 and 301 is set to 10 seconds, and the heating time of the welding portion 121 and the projection portion 123*c* of the joint member 120 is set to 6 seconds. The reason why the heating time of the joint member 120 is shorter than the heating time of the casing 110 is that the radiation heat from the heater blocks 300 and 301 more easily travels to the joint member 120 than to the casing 110 because the joint member 120 is held above the heater blocks 300 and 301.

Upon such heating, the distance between the projection portion 123*c* in the joint member 120 and the heater block 301 is favorably made sufficiently wide. The projection portion 123*c* in the joint member 120 does not come into direct contact with the heater block 301 by doing so, and a melted surface 123*d* formed is not sufficiently melted. In this embodiment, the distance between the heater block 301 and the melted surface 123*d* of the projection portion 123*c* in the joint member 120 is set to about 6.5 mm. The melted surface 123*d* of the projection portion 123*c* in the joint member 120 is thereby not heated to the melting point of polyethylene that is a raw material of the casing 110 and not sufficiently melted.

As illustrated in FIG. 5B, the holding part 400 then descends toward the casing 110, whereby the joint member 120 is pressed against the rib 111*a* of the opening 111 formed in the one side surface of the casing. As a result, the welding portion 121 of the joint member 120 and the rib 111*a* (see FIG. 5A) of the casing 110 are welded to each other because they are respectively melted. The melted surface 123*d* of the projection portion 123*c* abuts to the casing 110 without being welded because it is not sufficiently melted as described above.

In this embodiment, the welding portion 121 is cooled for 2 seconds after the holding part 400 has reached a descending end while retaining the state where the joint member 120 has been pressed against the casing 110 for the purpose of sufficiently welding the welding portion 121 and the rib 111*a* to each other. Thus, the welding portion 121 is cured in the state of being welded with the rib 111*a*, and so sufficient strength is imparted to the welding portion 121.

In the joint member 120, the cumulative height C (see FIG. 5C) between the melted surface 123*c* and the insertion space 123*a*, from the melted surface 123*d* of the projection portion 123*c* in the joint member 120, becomes lower than the height A+B (see FIG. 5A) of the positioning hole 123 before the welding.

Welding Process 2 of Joint Member:

Another process for welding the joint member 120 to the casing 110 is then described. In this embodiment, a heater block 302 obtained by integrating a heater block on the side of the welding portion 121 with a heater block on the side of the positioning hole 123 is used for the purpose of simplifying the construction of the apparatus used in "Welding process 1 of joint member" described above, thereby heating them at an equal heating temperature.

Figure 6:
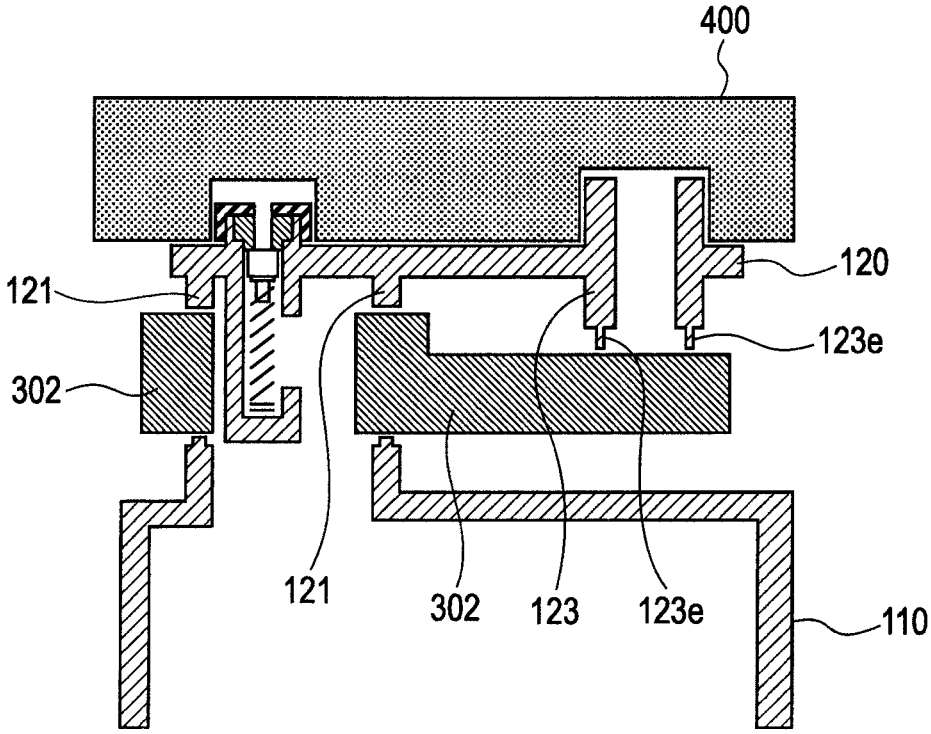
FIG. 6 illustrates a heating step for welding the joint member in the embodiment.
Figure 7:
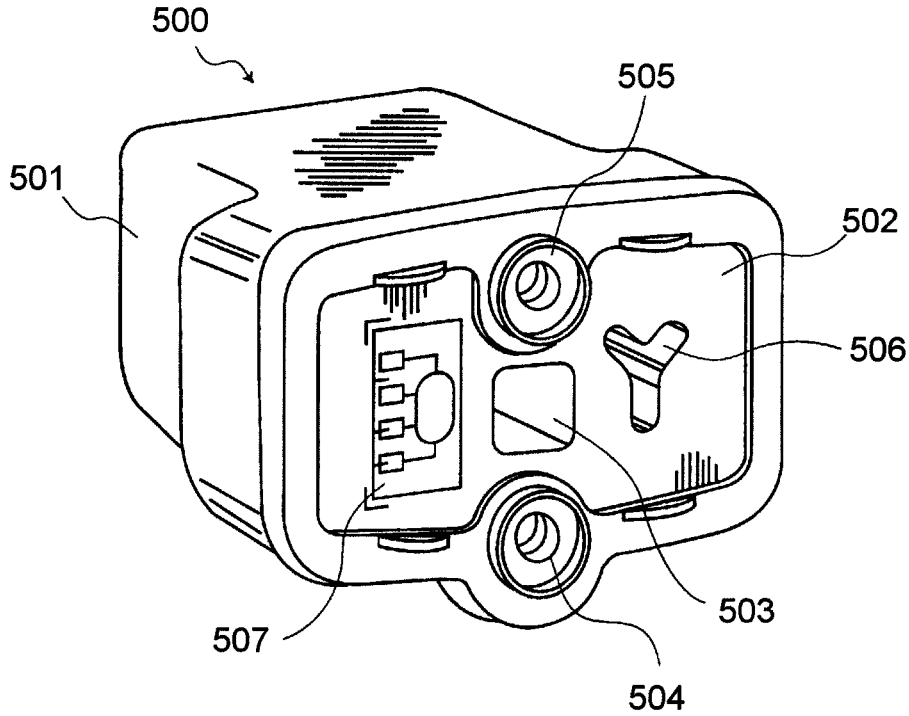
FIG. 7 is a perspective view illustrating a conventional ink tank.

In this embodiment, the projection portion 123*c* (see FIG. 5A) of the positioning hole 123 shown in Welding process 1 described above is made thinner than that used in Welding process 1 described above (see 123*e* in FIG. 6). In short, the of the projection portion 123*e* has such a wall thickness and form as to be easily melt-deformed, compared with the projection portion 123*c* in Welding process 1 described above. The projection portion 123*e* can thereby be surely and easily melt-deformed so as not to affect the joint of the welding portion and the rib 111*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-021793, filed Feb. 3, 2011, which is hereby incorporated by reference herein in its entirety.

What is claimed is:

1. An ink tank for being installed in an ink jet recording apparatus to supply an ink to the ink jet recording apparatus, the ink tank comprising:

an ink storage portion for storing the ink;

one side surface of a casing of the ink tank in which side surface an opening for supplying the ink to the ink jet recording apparatus is formed; and a one-piece joint member for joining the one side surface to the ink jet recording apparatus by engaging with a connection member of the ink jet recording apparatus, wherein the joint member has a welding portion for being welded to the one side surface along a peripheral portion of the opening, the welding portion corresponding to the peripheral portion; and a hollow portion forming a positioning hole for inserting therein and engaging therewith the connection member for positioning or determining a relative position of the ink jet recording apparatus and the one side surface which are to be joined to each other, and wherein the hollow portion is provided on the outside of the welding portion and abuts to the one side surface without being welded.

2. The ink tank according to claim 1, wherein the ink storage portion has a frame arranged on the inside of the opening in the one side surface of the ink tank and a valve mechanism that is inserted into the interior of the frame and is then capable of opening and closing the opening.

3. The ink tank according to claim 1, wherein the joint member is not fixed to the one side surface to the ink jet recording apparatus except at the welding portion.

4. The ink tank according to claim 1, wherein the one side surface to the ink jet recording apparatus is exposed from the positioning hole.

5. The ink tank according to claim 1, wherein the joint member and the casing of the ink tank are formed of the same resin.

6. A production process of an ink tank for being installed in an ink jet recording apparatus to supply an ink to the ink jet recording apparatus, the ink tank comprising:

an ink storage portion for storing the ink;

one side surface of a casing of the ink tank in which side surface an opening for supplying the ink to the ink jet recording apparatus is formed; and a one-piece joint member for joining the one side surface to the ink jet recording apparatus by engaging with a connection member of the ink jet recording apparatus, wherein the joint member has a substantially circular welding portion for being welded to the one side surface along a peripheral portion of the opening, the welding portion corresponding to the peripheral portion; and a hollow portion forming a positioning hole for inserting therein and engaging therewith the connection member for positioning or determining a relative position of the ink jet recording apparatus and the one side surface which are to be joined to each other, the process comprising:

a step of heating a peripheral portion of the opening formed in the one side surface, an end portion of the welding portion in the one-piece joint member and an end portion of the hollow portion;

a step of welding the melted peripheral portion of the opening to the welding portion in the one-piece joint member; and a step of deforming the melted end portion of the hollow portion to form an abutting surface for abutting to the one side surface without being welded.

7. The production process according to claim 6, wherein a heating temperature upon heating for melting the hollow portion is higher than a heating temperature upon heating for melting the welding portion.

8. The production process according to claim 6, wherein the joint member is not fixed to the one side surface to the ink jet recording apparatus except at the welding portion.

9. The production process according to claim 6, wherein the one side surface to the ink jet recording apparatus is exposed from the positioning hole.

10. The production process according to claim 6, wherein the joint member and the casing of the ink tank are formed of the same resin.

* * * * *